US011371149B2

(12) United States Patent
Wang et al.

(10) Patent No.: US 11,371,149 B2
(45) Date of Patent: Jun. 28, 2022

(54) NICKEL-BASED COATING COMPOSITION FOR IMPROVING DAMPING SHOCK ABSORBING PERFORMANCE OF CYLINDER HEAD OF DIESEL ENGINE, METHOD FOR PRODUCING THE SAME AND USE THEREOF

(71) Applicant: ACADEMY OF ARMORED FORCES ENGINEERING, Beijing (CN)

(72) Inventors: Haidou Wang, Beijing (CN); Zhiguo Xing, Beijing (CN); Lihong Dong, Beijing (CN); Congshuo Zhao, Beijing (CN); Yuelan Di, Beijing (CN); Guozheng Ma, Beijing (CN)

(73) Assignee: Academy of Armored Forces Engineering, Beijing (CN)

( * ) Notice: Subject to any disclaimer, the term of this patent is extended or adjusted under 35 U.S.C. 154(b) by 563 days.

(21) Appl. No.: 16/259,906

(22) Filed: Jan. 28, 2019

(65) Prior Publication Data

US 2019/0233948 A1 Aug. 1, 2019

(30) Foreign Application Priority Data

Jan. 29, 2018 (CN) ..... 201810082789.8

(51) Int. Cl.
*C22C 32/00* (2006.01)
*F02F 1/24* (2006.01)
(Continued)

(52) U.S. Cl.
CPC ..... *C23C 24/087* (2013.01); *B22F 3/15* (2013.01); *B22F 9/04* (2013.01); *C22C 32/001* (2013.01);
(Continued)

(58) Field of Classification Search
CPC ..... C23C 24/087; C23C 24/10; C23C 24/103; C22C 32/001; C22C 1/0433; F02F 1/26;
(Continued)

(56) References Cited

U.S. PATENT DOCUMENTS

2005/0073222 A1* 4/2005 Kampe ..... H01L 41/183 310/358
2007/0138917 A1 6/2007 Schultz et al.

FOREIGN PATENT DOCUMENTS

CN 104213251 A 12/2014
CN 104451524 A 3/2015
(Continued)

OTHER PUBLICATIONS

Hongjiang, Wang, "Research on Wear Failure Analysis and Remanufacturing of Steel Tube Cold Drawing Dies," Full-text Database of Excellent Master's Dissertations in China (Electronic Journal), No. 12, pp. B022-217, Dec. 12, 2015 (12 pgs). (Year: 2015).*
(Continued)

*Primary Examiner* — Rebecca Janssen
(74) *Attorney, Agent, or Firm* — Patterson Thuente Pedersen, P.A.

(57) ABSTRACT

Provided is a nickel-based composite coating, method for producing the same and use thereof. A powder mixture is coated on the surface of a substrate to obtain a nickel-based composite coating, wherein the powder mixture comprises nickel-chromium-boron-silicon powders and barium titanate powders. The barium titanate powders are added to the nickel-based powders as a second phase to form $BaTiO_3$—NiCrBSi metal-based ceramic composite coating. The nickel-based barium titanate composite coating has an excellent damping shock absorbing performance and gives the substrate strength as well. Comparing with the conventional coating materials, the coating obtained by the present disclosure through plasma cladding technique not only bonds
(Continued)

with the substrate in a metallurgic way, but also has a small heat affected zone, specifically, an excellent damping shock absorbing performance. In embodiments of the present disclosure, vibration and noise generated by the cylinder head is reduced 20% by using the shock absorbing cladding coating.

5 Claims, 2 Drawing Sheets

(51) Int. Cl.

| | |
|---|---|
| ***C22C 1/04*** | (2006.01) |
| ***C23C 24/08*** | (2006.01) |
| ***F02F 1/26*** | (2006.01) |
| ***B22F 3/15*** | (2006.01) |
| ***B22F 9/04*** | (2006.01) |
| *B22F 7/06* | (2006.01) |

(52) U.S. Cl.
CPC ..... *F02F 1/26* (2013.01); *B22F 2007/068* (2013.01); *B22F 2009/041* (2013.01); *B22F 2301/056* (2013.01); *B22F 2301/15* (2013.01); *B22F 2301/205* (2013.01); *B22F 2301/40* (2013.01); *B22F 2302/05* (2013.01); *B22F 2998/10* (2013.01); *C22C 1/0433* (2013.01); *F02F 2001/248* (2013.01)

(58) Field of Classification Search
CPC ..... F02F 2001/248; F02F 1/24; B22F 3/15; B22F 9/04; B22F 2998/10; B22F 2007/068; B22F 2302/05; B22F 2301/40; B22F 2301/056; B22F 2301/205; B22F 2301/15; B22F 2009/041
See application file for complete search history.

(56) References Cited

FOREIGN PATENT DOCUMENTS

| | | | |
|---|---|---|---|
| CN | 105002490 | A | 10/2015 |
| CN | 107620025 | A | 1/2018 |

OTHER PUBLICATIONS

Office Action dated Jul. 16, 2020 for Chinese Application No. 201810082789.8, 15 pages.
Chinese Office Action for Application No. 201810082789.8, dated Aug. 1, 2019 (15 pgs).
Hongjiang, Wang, "Research on Wear Failure Analysis and Remanufacturing of Steel Tube Cold Drawing Dies," Full-text Database of Excellent Master's Dissertations in China (Electronic Journal), No. 12, pp. B022-217, Dec. 12, 2015 (12 pgs).

* cited by examiner

NICKEL-BASED COATING COMPOSITION FOR IMPROVING DAMPING SHOCK ABSORBING PERFORMANCE OF CYLINDER HEAD OF DIESEL ENGINE, METHOD FOR PRODUCING THE SAME AND USE THEREOF

CROSS REFERENCE TO RELATED APPLICATIONS

This application claims the priority of Chinese Patent Application No. 201810082789.8, filed on Jan. 29, 2018, and the disclosures of which are hereby incorporated by reference.

FIELD

The present disclosure relates to the field of coating technology, specifically to a nickel-based composite coating, method for producing the same and use thereof, more specifically to a nickel-based composite coating for improving damping shock absorbing performance of the cylinder head of a diesel engine.

BACKGROUND

Basic requirements for cylinder heads of different-type diesel engines are the same, i.e., wear resistance, corrosion resistance and enough mechanical strength. Wears of a diesel engine during use come from: during the service of the cylinder head, both the mechanical movement and the attachment of deposited carbon of the air valve cause wear of the valve seat and the conduit; and the corrosion spots formed by chemical corrosion or electrochemical corrosion cause stress concentration in some parts of the cylinder head, resulting in cracks, thereby leading to part scrapping. The cylinder head is a combination structure of a body and an exhaust valve body, and the lower end of the fastening bolt of the air valve is installed on the cylinder head body. Fastening bolts are used to tighten the exhaust valve body, and the shoulder of the cylinder head body is a weak part in which the stress of cylinder head body concentrates, which bears the pressure of the fastening bolt from the sealing boss of the exhaust valve body. When the cylinder head is in operation for a long time, mechanical stress is generated as a result of machine vibration, and the stress concentrates on the bolt part of the cylinder head, thereby accelerating the damage of workpieces. The composite effect from the high frequency alternating mechanical stress caused by explosion pressure and the low frequency alternating thermal stress caused by heat load leads to the damage of cylinder head.

During the operation of an engine, vibration is generated between the inner wall of the chain chamber, the chain and the outer wall, which causes unavoidable noise. The vibration and noise generated by machinery are very common, which not only pollutes the environment, but also affects the machining accuracy of the machines and accelerates the damage and failure of the structure. In addition, vibration and noise also seriously endanger people's physical and mental health, which is an urgent problem to be solved in environmental engineering. With the improvement of the level of science and technology, research on engine noise reduction gets more and more attention.

At present, in view of the part scrapping caused by cylinder head vibration, to solve the vibration phenomenon in the service of the cylinder head, the structure of the cylinder head is improved or vibration damping structure is added to the cylinder head. The damping structure of the cylinder head is complicated. Changing the structure of the cylinder head involves the inner wall of the chain, the outer wall, the threaded hole and the connecting hole, etc., which will increase the manufacturing cost of the cylinder head.

For the wear and crack areas caused by the vibration, one solution is to remove the material on these areas and prepare a repair layer having a function of strengthening and shock absorbing. At present, in order to meet the requirements of the surface of the cylinder head, techniques such as plasma spraying, plasma cladding and the like can be used to strengthen the surface of mechanical components such as cylinder heads. For example, the Chinese patent document (publication No. CN104451524A) discloses NiCrBSi coating that is automatically prepared by plasma spraying, followed by vacuum remelting treatment to form a metallurgical bond, and the tooling is used to solve the coating problem existing in the painted section.

Although coatings prepared by the conventional techniques above improve the wear resistance of substrate in some degree, the coatings do not have an outstanding performance in the aspect of improving shock absorbing performance.

SUMMARY

In order to solve the technical problems above, the present disclosure provides a nickel-based composite coating, method for producing the same and use thereof, the nickel-based composite coating provided by the present disclosure has good damping shock absorbing performance, which improves damping shock absorbing performance of the cylinder head of a diesel engine.

The present disclosure provides a nickel-based composite coating, which is formed by a powder mixture on the surface of a substrate, and the powder mixture comprises nickel-chromium-boron-silicon powders and barium titanate powders.

Preferably, the mass ratio of the barium titanate powders to the nickel-chromium-boron-silicon powders is 1:1~8.

Preferably, the particle sizes of the barium titanate powders and the nickel-chromium-boron-silicon powders are independently 150~325 mesh.

The present disclosure provides a method for producing the nickel-based composite coating, comprising cladding a powder mixture on the surface of a substrate to obtain a nickel-based composite coating, wherein the powder mixture comprises nickel-chromium-boron-silicon powders and barium titanate powders.

Preferably, the cladding is plasma cladding.

Preferably, prior to the cladding, the method further comprises preheating the substrate to 300° C.

Preferably, upon the cladding, the method further comprises subjecting the substrate to slow cooling treatment and machining treatment.

Use of the above-mentioned nickel-based composite coating for coating or repairing the cylinder head of an engine.

Comparing with the conventional art, in the present disclosure, barium titanate ceramic is added to the nickel-based powders as a second phase to form a $BaTiO_3$—NiCrBSi metal-based ceramic composite coating. In the present disclosure, the nickel-based barium titanate composite coating has an excellent damping shock absorbing performance, and gives the substrate strength as well, beneficial to the application of preparing and repairing workpieces.

In addition, comparing with the conventional cladding material phases, in the present disclosure, a plasma cladding technique is preferred to obtain the cladding layer, by which the cladding layer bonds with the substrate in a metallurgic way, but also has a small heat affected zone, specifically, and an excellent damping shock absorbing performance. In embodiments of the present disclosure, vibration and noise generated by the cylinder head is reduced 20% by using the shock absorbing cladding coating.

DETAILED DESCRIPTION

Figure 1:
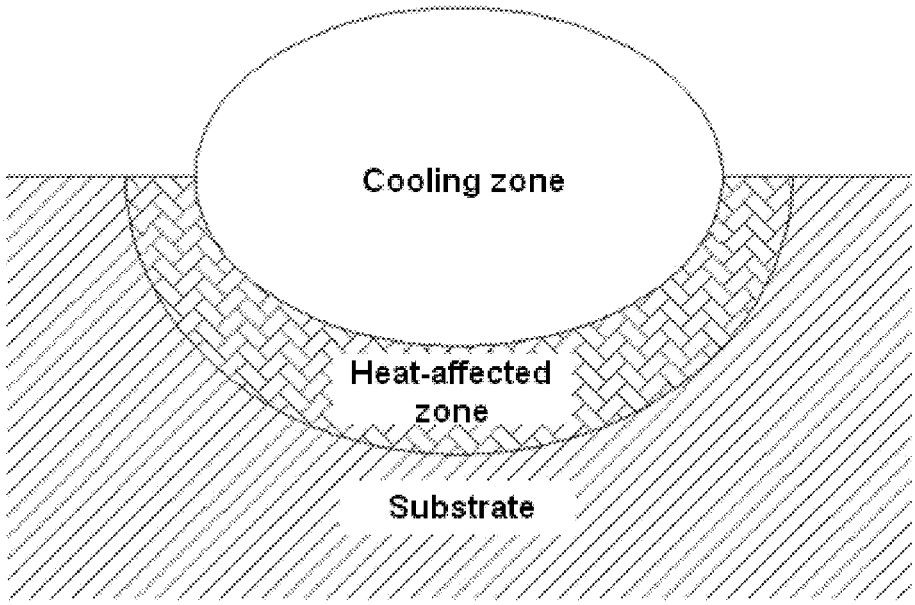
FIG. 1 is a schematic structural diagram of the cladding layer obtained in an example of the present disclosure.

In order to understand the present disclosure better, preferred embodiments of the present disclosure will be illustrated hereinafter in conjunction with examples. However, it should be understood that those description merely tends to further describing the characters and advantages of the present disclosure, and not tends to limit of the claims of the present disclosure.

The present disclosure provides a nickel-based composite coating, which is formed by a powder mixture on the surface of a substrate, and the powder mixture comprises nickel-chromium-boron-silicon powders and barium titanate powders.

The nickel based composite coating can improve the damping shock absorbing performance of workpieces such as the cylinder head of a diesel engine, etc., give strengthen to the substrate and benefit the application.

The powder mixture forming the nickel-based composite coating of the present disclosure comprises nickel-chromium-boron-silicon powders. Nickel-chromium-boron-silicon (NiCrBSi) is a nickel-based alloy that comprises elements such as chromium (Cr), boron (B), silicon (Si), etc., which has excellent performances such as wear resistance, corrosion resistance, impact resistance, etc., and is widely used. The nickel-chromium-boron-silicon powders may be nickel-chromium-boron-silicon alloy powders of commercially pure, and the particle size thereof is preferably 150~325 mesh.

In the present disclosure, the powder mixture comprises barium titanate powders; and the mass ratio of the barium titanate powders to the nickel-chromium-boron-silicon powders is preferably 1:1~8, and more preferably 1:7~8. Barium titanate ($BaTiO_3$) is a compound material with strong dielectric property, which has a high dielectric constant and low dielectric loss, and is widely used in electric ceramics. The barium titanate powders are generally white powders, and the particle size is preferably 150~325 mesh. In the present disclosure, barium titanate powers are added to the above-mentioned nickel-based powders as the second phase to form a $BaTiO_3$—NiCrBSi metal-based ceramic composite coating. In the present disclosure, the nickel-based barium titanate composite coating has excellent damping shock absorbing performance, and further has a function of strengthening the substrate.

In the present disclosure, the powder mixture, i.e., $BaTiO_3$—NiCrBSi mixing powders or composite powders, may be at nano level. In an embodiment of the present disclosure, $BaTiO_3$ and NiCrBSi are mixed at a weight ratio of 1:1~8 to prepare a metal-based ceramic composite coating material. The composite powders are prepared through mixing, hot-pressing sintering and milling, and the specific manufacturing process is: (1) mixing the compositions uniformly by mechanically blending; (2) filling the dry powders into the model in a hot-pressing sintering furnace, pressing and heating along a direction of a single axis so that the materials are molded and sintered; and (3) milling the sintered block material until an even particle size is obtained, and drying the mixed powders. In some embodiments of the present disclosure, the mass fraction of barium titanate in the composite powders is 8 wt %.

In the present disclosure, the nickel-based composite coating is preferably a nickel-based barium titanate composite cladding layer prepared by plasma cladding technique, which strengthens the workpieces and improves the damping shock absorbing performance of the surface of the workpieces. The cladding layer can be used at the sensitive surface of workpieces, which are easy to be worn or effected by shock or noise.

Correspondingly, the present disclosure provides a method for producing the nickel-based composite coating, comprising: cladding a powder mixture on the surface of a substrate to obtain a nickel-based composite coating, wherein the powder mixture comprises nickel-chromium-boron-silicon powders and barium titanate powders.

In order to overcome the defects of the conventional materials, the present disclosure provides a method for preparing a nickel-chromium-boron-silicon-barium titanate composite coating by plasma cladding technique.

In the present disclosure, the plasma cladding technique is preferred. The plasma cladding technique is an effective and practical surface treatment technique. It has advantages such as high bonding strength between the cladding layer and the substrate, uniformly and fine coating structure, good comprehensive properties, low cost, and so on. There is existing developed equipment and craft for the plasma cladding, and according to different substrate materials (e.g., iron-carbon alloy, nonferrous alloy, etc) and cladding material with different melting points and composition, surface coating having different properties can be prepared on the surface of the substrates, for example ceramic coating.

In the method provided by the present disclosure, the above-mentioned powder mixture is used as a cladding material, which is a high quality coating material comprising nickel-chromium-boron-silicon powders and barium titanate powders. The composition of the coating material and method for preparing the same are the same as that described above, and are not illustrated again herein.

In the present disclosure, the substrate is preferably a metal substrate, and the substrate may be components such as the cylinder head of a diesel engine etc., or other workpieces. In some embodiments of the present disclosure, a cladding layer having a shock absorbing and noise lowering performance can be provided on the bottom, or the upper and lower surface of the cylinder head. The cladding layer may be subjected to post-processing to avoid the effect on the installation and use of the cylinder head. In the embodiments of the present disclosure, the surface of the cylinder head may be cleaned before cladding, such as degreasing and descaling.

Preferably, in some embodiments of the present disclosure, prior to the cladding, the substrate is preheated to 300°

C., which facilitates preparing a plasma cladding composite coating on the surface of the substrate. Specifically, oxygen-acetylene flame can be used to heat the HT250 substrate to 300° C.

In embodiments of the present disclosure, the above powder mixture is coated on the surface of the substrate to obtain the nickel-based composite coating. In the present disclosure, there is not special restriction on the plasma cladding equipment. The operating parameters of the plasma cladding in some embodiments of present disclosure are: operating current 50~70 A, scanning rate 1~2 mm/s, powder feed rate 1~3 r/min, plasma gas flow rate 4~6 L/min, protective gas flow rate 4~6 L/min, powder feeding flow rate 3~6 L/min, and distance to the nozzle is 5~10 mm. The schematic structural diagram of the obtained cladding layer is shown in FIG. 1. In the embodiments of the present disclosure, the cladding layer is obtained by plasma cladding. The cladding layer is not only bonds with the substrate in a metallurgic way, but also has a small heat affected zone, and a more excellent damping shock absorbing performance.

After cladding, the method provided by the present disclosure preferably further comprises: subjecting the substrate to a slow cooling treatment and a machining treatment. The slow cooling treatment is a thermal insulation treatment, and a constant temperature oven can be used to maintain the temperature. In the present disclosure, the thermal insulation duration of the slow cooling treatment is preferably 1 h~2 h. After sufficient thermal insulation, the substrate is cooled along with the constant temperature oven, or cooled to a certain temperature and then subjected to air-cooling out of the oven. In embodiments of the present disclosure, the substrate coated with a shock absorbing cladding layer is subjected to machining treatments so that it conforms to the dimensional requirements of a cylinder head for use.

In addition, the present disclosure also provides use of the nickel-based composite coating in manufacturing or repairing the cylinder head of an engine.

In order to measure the properties of the obtained coating, Nova NanoSEM450 type scanning electron microscope is used in the present disclosure to observe the morphologies of the surface and cross-section of the coating. In the present disclosure, gray-level method is used to measure the porosity of the coating, and the specific steps are: subjecting the metallographic SEM image of the cross-section of the coating to stretching and enhancing by gray-level method, so that the air holes are shown due to a darker background; with the diagram processing software developed by National Defense Science and Technology Key Laboratory of Equipment Remanufacturing Technology, area fraction that the exposed air holes take up in the area of cross section is calculated and recorded as the porosity of the coating.

The energy flow of the vibration structure is generally the average power P in a period of time t, and the formula for calculating is shown hereinafter:

$$P = \frac{1}{T}\int_0^T |F|\cdot|V|dt; \tag{1}$$

and in formula (1), |F| is the amplitude of the exciting force, |V| is the amplitude of the response velocity, and T is the time period of the exciting force F.

If both the exciting force and the response velocity are simple harmonic variables, they can be denoted as follows:

$$F(\omega,t)=Re\{\tilde{F}\cdot e^{j\omega t}\} \tag{2};$$

$$V(\omega,t)=Re\{\tilde{V}\cdot e^{j\omega t}\} \tag{3};$$

in formula (2) and (3), Re denotes that the real part is used, $\tilde{F}$ and $\tilde{V}$ are respectively the complex number form of the exciting force F and the response velocity V, comprising the phase angle, and ω is angle frequency.

In order to evaluate the damping shock absorbing effects of the pedestal, the vibration level difference $L_D$ of the acceleration of the vibration source from the excitation point on the pedestal panel to the hull structure is defined hereinafter:

$$L_D = 10\lg\left(\frac{a_t^2}{a_0^2}\right) = 10\lg\left(\frac{\sum_{i=1}^{D} a_i^2/N}{a_0^2}\right); \tag{4}$$

and in formula (4), $a_t$ is the amplitude of the average acceleration of the hull structure; $a_0$ is the amplitude of acceleration of the excitation points, N is the number of the observation points of acceleration on the hull plate; and $a_i$ is the amplitude of acceleration of each observation points on the hull plate.

The main test equipment may be B&K3160 type data acquisition software front-end and a B&K PULSE signal analysis system (Denmark); and the exciting system includes B&K3160 signal source, B&K2707 power amplifier and B&K4809 vibration exciter. The white noise signal generated by the signal generator actuates the vibration exciter after power amplifying, exciting the pedestal panel structure. An impedance head, sensors of force and acceleration are used to collect the vibration signals simultaneously. In the test, the exciting force is maintained basically constant through adjusting the current of the power amplifier.

According to the test results above, the advantages and benefits of the present disclosure are: the nickel-based barium titanate composite coating has excellent damping shock absorbing performance and gives strength to the substrate. As to conventional pure nickel coatings, there is huge difference of thermal expansion coefficient between nickel and the substrate, so that the obtained coating is easy to generate a residual stress, thereby leading to the generation of cracks. Currently, there are coatings of nickel and alloys thereof that are prepared by plasma transferred wire arc (PTWA). But the defect of low bonding strength is not solved. Especially under impact load, the spraying coating cannot bond well with the substrate and peels off easily. Comparing with the conventional cladding materials, in the present disclosure, the cladding layer is obtained by plasma cladding, which not only bonds with the substrate in a metallurgic way, but also has a small heat affected zone, specifically, an excellent damping shock absorbing performance. In embodiments of the present disclosure, vibration and noise generated by the cylinder head is reduced 20% by using the shock absorbing cladding coating.

For a better understanding of the present disclosure, the nickel-based composite coating, the method for producing the same and the use thereof will be described in detail in conjunction with embodiments hereinafter.

EXAMPLE 1

A method for producing the nickel-based composite coating comprises the following specific steps.

(1) Prepare the metal-based ceramic composite coating material.

(a) The nickel-chromium-boron-silicon powders (particle size 200 mesh) and the barium titanate powders (particle size 200 mesh) are mechanically mixed evenly in a weight ratio of 1:8 (the purity of the two powders are both 99.9%, provided by Mining and Metallurgical Research Institute); (b) the obtained dry mixing powders are filled into the model in a hot-pressing sintering furnace and subjected to pressing and heating along a direction of a single axis, so that the materials are molded and sintered; and (c) the sintered block material were milled until an even particle size is obtained, and the mixed powders are dried to obtain $BaTiO_3$—NiCrBSi nanoparticles.

(2) The surface of the cylinder head (HT250 substrate) to be coated is subjected to degreasing and descaling treatment.

(3) The cylinder head obtained in (2) is preheated to 300° C.

(4) The powders obtained in (1) are used to prepare a plasma cladding composite layer on the surface of the preheated substrate, and the thickness of the coating is 2.5 mm. A plasma cladding equipment manufactured by Armored Force Engineering College is used, and the cladding parameters are: operating current 70 A, scanning rate 2 mm/s, powder feed rate 1.5 r/min, plasma gas flow rate 6 L/min, protective gas flow rate 6 L/min, powder feeding flow rate 6 L/min, and distance to the nozzle is 10 mm.

(5) The coated substrate is subjected to thermal insulation in a constant temperature oven for 1 h. After sufficient thermal insulation, the substrate is cooled along with the constant temperature oven. The cooled substrate is subjected to machining treatments to meet the dimensional requirements of a cylinder head for use.

Figure 2:
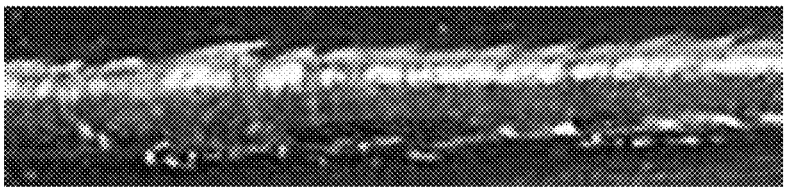
FIG. 2 is a macrograph of the cladding layer obtained in an example of the present disclosure.
Figure 3:
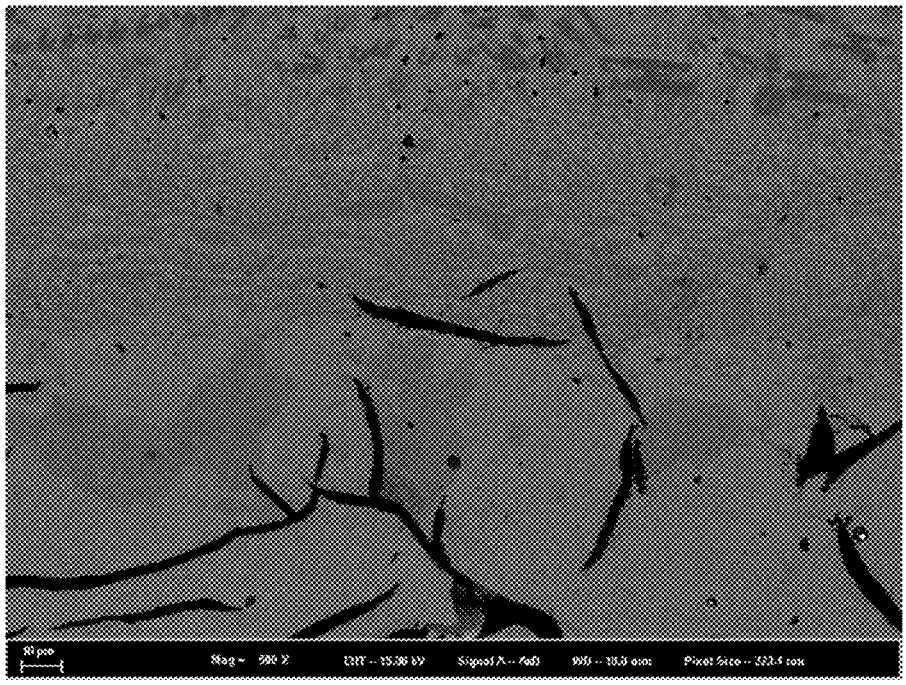
FIG. 3 is a microstructure diagram of the bonding region of the cladding layer obtained in an example of the present disclosure.
Figure 4:
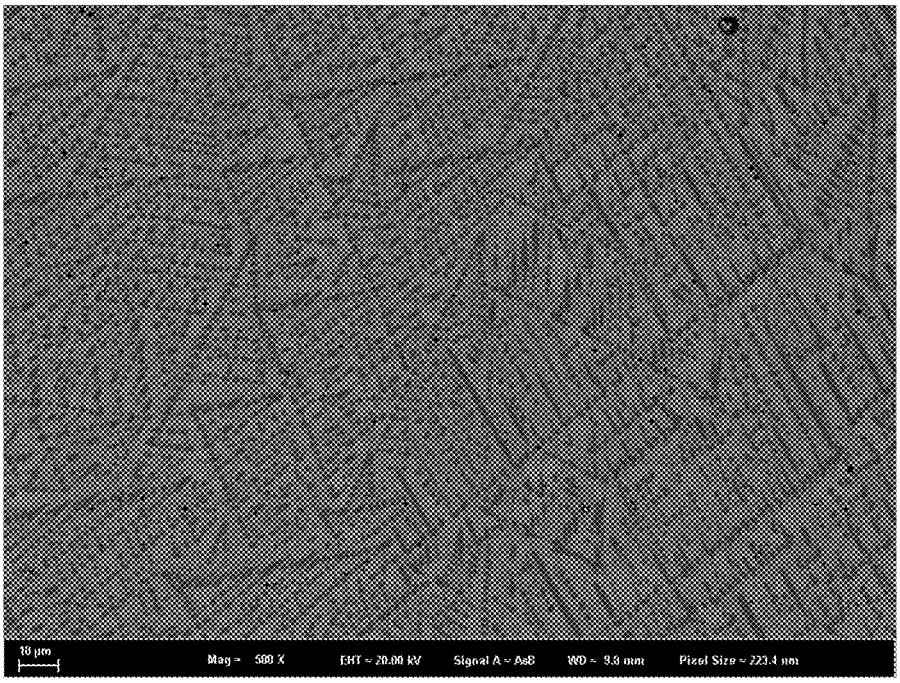
FIG. 4 is a microstructure diagram of the central part of the cladding layer obtained in an example of the present disclosure.

The morphology and porosity of the coating, and the damping shock absorbing performance of the workpiece are tested and analyzed according to the method described above. The results are shown in FIGS. 1 to 4. FIG. 1 is a schematic structural diagram of the cladding layer obtained in the example of the present disclosure; FIG. 2 is a macrograph of the cladding layer obtained in the example of the present disclosure; FIG. 3 is a microstructure diagram of the bonding region of the cladding layer obtained in the example of the present disclosure; and FIG. 4 is a microstructure diagram of the central part of the cladding layer obtained in an example of the present disclosure. It can be concluded that the obtained coating has a smooth surface and a dense microstructure without microcracks. The heat effect of which on the substrate is minor, and the workpiece has little deformation. The dilution rate of the coating is 22%. The damping ratio of the cylinder head using the coating improves 10%.

The engine is the power source of the vehicle, and its power performance will directly affect the performance and service life of the vehicle. The vibration frequency of the engine cylinder head is an important parameter reflecting the state and performance of the engine and is directly related to the service life of the engine. By repairing the cylinder head with the coating of the present disclosure, it is found that the vibration frequency of the repaired cylinder head is also reduced, which effectively improves the efficiency of the engine. The results are shown in Table 1.

TABLE 1

Comparison of the performances of the cylinder head before and after repairing with the coating of the present disclosure

| | Power | Vibration Frequency | Weight | Noise Rate |
|---|---|---|---|---|
| Before | 1000 r/m | 2980 hz | 1.5 t | 100 dba |
| After | 1000 r/m | 2360 hz | 1.5 t | 79 dba |

EXAMPLE 2

A method for producing the nickel-based composite coating comprises the following specific steps.

(1) Prepare the metal-based ceramic composite coating material.

(a) The nickel-chromium-boron-silicon powders (particle size 200 mesh) and the barium titanate powders (particle size 200 mesh) are mechanically mixed evenly in a weight ratio of 1:7 (the purity of the two powders are both 99.9%, provided by Mining and Metallurgical Research Institute); (b) the obtained dry mixing powders are filled into the model in a hot-pressing sintering furnace and subjected to pressing and heating along a direction of a single axis, so that the materials are molded and sintered; and (c) the sintered block material were milled until an even particle size is obtained, and the mixed powders are dried to obtain $BaTiO_3$—NiCrBSi nanoparticles.

(2) The surface of the cylinder head (HT250 substrate) to be coated is subjected to degreasing and descaling treatment.

(3) The cylinder head obtained in (2) is preheated to 300° C.

(4) The powders obtained in (1) is used to prepare a plasma cladding composite layer on the surface of the preheated substrate, and the thickness of the coating is 2 mm. A plasma cladding equipment manufactured by Armored Force Engineering College is used, and the cladding parameters are: operating current 65 A, scanning rate 1.5 mm/s, powder feed rate 1.8 r/min, plasma gas flow rate 5 L/min, protective gas flow rate 5 L/min, powder feeding flow rate 5 L/min, and distance to the nozzle is 8 mm.

(5) The coated substrate is subjected to thermal insulation in a constant temperature oven for 2 h. After sufficient thermal insulation, the substrate is cooled along with the constant temperature oven. The cooled substrate is subjected to machining treatments to meet the dimensional requirements of a cylinder head for use.

The morphology and porosity of the coating, and the damping shock absorbing performance of the workpiece are tested and analyzed according to the method described above. It can be concluded that the obtained coating has a smooth surface structure and an even microstructure, and forms metallurgical bond with the substrate. The bonding strength is high, and there are not defects such as cracks or air hole. The damping ratio of the cylinder head using the coating improves 12%.

TABLE 2

Comparison of the performances of the cylinder head before and after repairing with the coating of the present disclosure

| | Power | Vibration Frequency | Weight | Noise Rate |
|---|---|---|---|---|
| Before | 800 r/m | 2490 hz | 1.5 t | 80 dba |
| After | 800 r/m | 1950 hz | 1.5 t | 62 dba |

From the above examples, it can be concluded that in the present disclosure, barium titanate ceramic is added to the nickel-based powders as a second phase to form $BaTiO_3$—NiCrBSi metal-based ceramic composite coating. In the present disclosure, the nickel-based barium titanate composite coating has an excellent damping shock absorbing performance, and gives the substrate strength as well. In embodiments of present disclosure, vibration and noise generated by the cylinder head is reduced 20% by using the shock absorbing cladding coating, showing a huge application prospect.

The above description of the embodiments is merely to assist in understanding the method of the present disclosure and its core idea. It should be noted that one of ordinary skill in the art can make various modifications and changes to the present disclosure without departing from the spirit and scope of the disclosure.

The invention claimed is:

1. A nickel-based composite coating formed by a powder mixture by plasma cladding on the surface of a substrate, wherein the powder mixture comprises nickel-chromium-boron-silicon powders and barium titanate powders;

wherein a mass ratio of the barium titanate powders to the nickel-chromium-boron-silicon powders is 1:7-8; and particle sizes of the barium titanate powders and the nickel-chromium-boron-silicon powders are independently 150-325 mesh.

2. A method for producing a nickel-based composite coating according to claim 1, comprising plasma cladding a powder mixture on the surface of a substrate to obtain a nickel-based composite coating, wherein the powder mixture comprises nickel-chromium-boron-silicon powders and barium titanate powders;

wherein a mass ratio of the barium titanate powders to the nickel-chromium-boron-silicon powders is 1:7-8; and particle sizes of the barium titanate powders and the nickel-chromium-boron-silicon powders are independently 150-325 mesh.

3. The method according to claim 2, prior to the cladding, further comprises preheating the substrate to 300° C.

4. The method according to claim 3, upon the cladding, further comprises subjecting the substrate to slow cooling treatment and machining treatment.

5. A method of coating or repairing the cylinder head of an engine, comprising using the nickel-based composite coating according to claim 1.

* * * * *